US011363701B2

(12) United States Patent
Adenau

(10) Patent No.: US 11,363,701 B2
(45) Date of Patent: Jun. 14, 2022

(54) METHOD FOR CONTROLLING A LIGHTING SYSTEM USING A LIGHTING CONTROL CONSOLE

(71) Applicant: MA LIGHTING TECHNOLOGY GMBH, Waldbüttelbrunn (DE)

(72) Inventor: Michael Adenau, Würzburg (DE)

(73) Assignee: MA LIGHTING TECHNOLOGY GMBH, Waldbüttelbrunn (DE)

( * ) Notice: Subject to any disclaimer, the term of this patent is extended or adjusted under 35 U.S.C. 154(b) by 78 days.

(21) Appl. No.: 16/318,919

(22) PCT Filed: Dec. 11, 2017

(86) PCT No.: PCT/EP2017/082174
§ 371 (c)(1),
(2) Date: Jan. 18, 2019

(87) PCT Pub. No.: WO2019/114920
PCT Pub. Date: Jun. 20, 2019

(65) Prior Publication Data
US 2021/0368606 A1 Nov. 25, 2021

(51) Int. Cl.
*H05B 47/155* (2020.01)
*H05B 47/12* (2020.01)

(52) U.S. Cl.
CPC ..... *H05B 47/155* (2020.01); *H05B 47/12* (2020.01)

(58) Field of Classification Search
CPC ..... H05B 47/155; H05B 47/12; Y02B 20/40
See application file for complete search history.

(56) References Cited

U.S. PATENT DOCUMENTS

| | | | | |
|---|---|---|---|---|
| 4,980,806 | A * | 12/1990 | Taylor | H05B 47/12 362/85 |
| 5,191,264 | A | 3/1993 | Hammond | |
| 5,406,176 | A * | 4/1995 | Sugden | H05B 47/155 362/85 |
| 6,545,586 | B1 | 4/2003 | Belliveau | |
| 8,405,323 | B2 * | 3/2013 | Finney | H05B 47/155 315/130 |
| 9,871,616 | B2 * | 1/2018 | Bell | H04L 1/00 |
| 10,197,224 | B1 * | 2/2019 | Macias | F21V 7/005 |
| 10,571,115 | B2 * | 2/2020 | Simon | F21V 33/0076 |
| 10,694,022 | B1 * | 6/2020 | Gupta | H04M 1/72454 |
| 11,096,008 | B1 * | 8/2021 | Batten | H04W 4/185 |
| 2008/0062692 | A1 * | 3/2008 | Andersen | F21V 29/75 362/275 |
| 2011/0080098 | A1 * | 4/2011 | Harris | F21V 29/61 315/117 |
| 2012/0063116 | A1 * | 3/2012 | Baxter | F21V 29/673 362/6 |
| 2013/0100678 | A1 * | 4/2013 | Baxter | F21V 29/54 362/311.06 |
| 2014/0253032 | A1 | 9/2014 | Bruwer et al. | |
| 2014/0335910 | A1 | 11/2014 | Wang | |
| 2015/0181676 | A1 | 6/2015 | Zar | |
| 2015/0287310 | A1 * | 10/2015 | Deliuliis | G08B 21/10 340/628 |
| 2016/0055324 | A1 * | 2/2016 | Agarwal | G06F 21/31 726/17 |
| 2016/0163302 | A1 * | 6/2016 | Klabunde | G10K 11/16 381/56 |
| 2016/0199977 | A1 * | 7/2016 | Breazeal | B25J 9/1694 700/246 |
| 2016/0241555 | A1 * | 8/2016 | Vo | G06F 3/04817 |
| 2016/0314782 | A1 * | 10/2016 | Klimanis | G10L 15/065 |
| 2017/0257096 | A1 | 9/2017 | Lark, Jr. et al. | |
| 2017/0290132 | A1 * | 10/2017 | Amrine | H05B 45/20 |
| 2017/0323356 | A1 | 11/2017 | Gharabegian | |
| 2017/0363942 | A1 * | 12/2017 | Hiramatsu | H04N 9/315 |
| 2018/0090010 | A1 * | 3/2018 | Ikehara | G06K 9/00335 |
| 2019/0132928 | A1 * | 5/2019 | Rodinger | H05B 47/19 |
| 2020/0383190 | A1 * | 12/2020 | Adenau | H05B 47/12 |
| 2021/0037278 | A1 * | 2/2021 | Leclerc | G06F 1/163 |

FOREIGN PATENT DOCUMENTS

| | | | |
|---|---|---|---|
| CA | 2977481 | A1 | 9/2016 |
| CN | 105144048 | A | 12/2015 |
| EP | 2040360 | A1 | 3/2009 |
| KR | 1020130073620 | A | 7/2013 |
| WO | 2004100611 | A1 | 11/2004 |

OTHER PUBLICATIONS

GrandMA User Manual (Year: 2016).*
"Move In Black (MIB)", https://web.archive.org/web/20160402121540/http://www.horizoncontrol.com/mqhelp/general_help/move_in_black.htm, Apr. 2, 2016, 3 pages.
PCT English Language Translation of the International Preliminary Report on Patentability, PCT/EP2017/082174, dated Jun. 25, 2020, 9 pages.
PCT International Search Report, PCT/EP2017/082174, dated May 30, 2018, 2 pages.
China National Intellectual Property Administration, First Office Action and Search Report, Application No. 201780050199.0, dated Dec. 13, 2021, 14 pages.

(Continued)

*Primary Examiner* — Borna Alaeddini
(74) *Attorney, Agent, or Firm* — Quarles & Brady LLP

(57) ABSTRACT

A method for controlling a lighting system using a lighting control console generating digital adjusting commands transmitted to lighting devices of the lighting system via data links at least one moving an adjustable lighting device towards different positions, and a preprogrammed lighting program being carried out in several consecutive program steps, an acoustic parameter characterizing the noise sensitivity being assigned to each programs step. The method includes driving the actuator towards the next predefined position of the lighting device as a function of a result of a comparison of the acoustic parameters of the program steps.

3 Claims, No Drawings

(56) References Cited

OTHER PUBLICATIONS

Wei et al., The Optimization Design of Embedded Control System for LED Stage Lights, Journal of Guangdong University of Technology, 2015, 32(3):110-114.
Yoshida et al., Reduction of Light Source Noise from Optical Intrinsic Signals of Mouse Neocortex by Using Independent Component Analysis, In 2015 37th Annual International Conference of the IEEE Engineering in Medicine and Biology Society (EMBC), pp. 6277-6280.

* cited by examiner

METHOD FOR CONTROLLING A LIGHTING SYSTEM USING A LIGHTING CONTROL CONSOLE

CROSS-REFERENCE TO RELATED APPLICATIONS

This application represents the national stage entry of PCT International Application No. PCT/EP2017/082174 filed Dec. 11, 2017. The contents of this application are hereby incorporated by reference as if set forth in their entirety herein.

The invention relates to a method for controlling a lighting system using a lighting control console, according to the preamble of claim 1.

Lighting control consoles serve for controlling lighting systems such as those employed in theaters or in concert halls, for instance. Routinely, said lighting systems comprise a plurality of lighting devices, for instance stage spotlights, wherein, the lighting devices on their own are in many cases also able to distinguish between a plurality of lighting states, for instance between different colors. These different lighting states are controlled in the lighting program of the lighting control console by way of programmed parameters. Here, standard lighting systems may comprise up to several thousand lighting devices.

With each lighting device, at least one light effect, for instance a beam of light, can be generated in order to light the stage with these light effects, which in many cases overlap. The generic method here relates to controlling lighting devices that are adjusted using at least one actuator in order to be able to move towards different positions of the lighting device. If said lighting device is, for instance, a stage spotlight, the beam of light of the spotlight can be pivoted freely across the stage by moving the corresponding actuators in two axes in order to follow, for instance, the main protagonist.

From the state of the art, a lighting method is known that is referred to as "Move in Black". The aim of this "Move in Black" method is to completely switch off the corresponding light effect of the lighting device before moving towards a new position of the lighting device in order to prevent that the audience perceives the movement of the spotlight while the next predefined position is being approached. The "Move in Black" control concept is here substantially based on three steps. In the first step, the lighting device is initially switched off under program control so that the lighting device generates no light effects anymore. Subsequently, after the lighting device has completely gone out, the actuator is activated by the lighting control console under program control in order to move towards the next predefined position of the lighting device using the actuators. In the third step, the lighting device is then switched on again after the predefined position has been reached in order to generate the light effect at the predefined time. The lighting device can, as a matter of course, also be switched on or off in the manner of a dimming process, during which the luminosity of the lighting device is regulated up or down along a dimming curve.

By means of the "Move in Black" method, undesired optical effects that occur when a lighting device is moved while the light source remains switched on are avoided. However, even with the "Move in Black" method, undesired disturbances of the stage show can arise, namely owing to undesired acoustical interferences. This is because, depending on the type of the respective lighting device, considerable engine noise can arise due to the driving of the actuators, which noise acoustically impairs the stage show when the ambient noise level is correspondingly low. If, for instance on a theater stage, an actor delivers a monologue in a certain scene, there is almost no noise in the auditorium at this time.

If, during such a monologue scene, a stage spotlight was then moved to the next predefined lighting position in advance, the audience would perceive this as a considerable acoustical interference.

It is therefore the object of the present invention to propose an enhanced "Move in Black" method with which acoustical interferences resulting from the lighting devices being moved can be avoided.

This object is attained by a method according to the teachings of claim 1.

Advantageous embodiments of the invention are the subject-matter of the dependent claims.

The inventive method is based on the fundamental idea that each program step of the lighting program carried out successively is assigned an acoustic parameter. Said acoustic parameter characterizes the noise sensitivity of each assigned program step. If, for example, a monologue scene with no ambient noise is played in the theater during a program step of the lighting program, an acoustic parameter having a high noise sensitivity can be assigned to this program step. It is, for instance, possible to assign an acoustic parameter from a scale of values ranging from 1 to 10 to each program step, an acoustic parameter having the value 1 defining a program step with high noise sensitivity and an acoustic parameter having the value 10 defining a program step with low noise sensitivity. In this way, acoustic parameters characterizing the noise sensitivity of the respective scene on the stage can be assigned to each program step of the lighting program.

During the program sequence for carrying out the lighting program, it is then possible to compare all program steps between method step a) and method step c) with regard to their acoustic parameters. The adjustment of the lighting device by driving it using the assigned actuator is carried out as a function of the result of the comparison of the different acoustic parameters that have been compared with each other. In other words, this means that after switching off the lighting device, the program steps to be carried out before switching the lighting device back on are compared with each other with regard to their noise sensitivity, this comparison allowing to determine the preferred program step during which an adjustment of the lighting device can be carried out due to the respective program step having a low noise sensitivity. Lastly, the lighting device is switched back on after reaching its predefined position.

According to a preferred variant of the method, the adjustment of the lighting device by driving it using the assigned actuator is carried out during the program step of the lighting program between method step a) and method step c) having the acoustic parameter with the lowest noise sensitivity.

If the actuators are activated as a function of the result of the comparison of the acoustic parameters of the different program steps, this can result in the problem that this comparison does not lead to an unambiguous result as, for instance, all acoustic parameters are the same. In this case, the lighting program would no longer be able to fulfil its intended purpose because the desired lighting effect would no longer be achievable due to the lighting device not being positioned. In order to prevent this from happening in any case, it is envisaged in accordance with a preferred embodiment that the adjustment of the lighting device by driving it using the assigned actuator is started, irrespective of the result of the comparison, at a point of time lying ahead, by the travel time that is needed for moving towards the next position, of the point of time of the next switching-on of the lighting device under program control. In other words, this means that the actuators are switched on at the latest when there is still enough time for moving towards the next predefined position, even if the comparison of the acoustic parameters has not led to an unambiguous result. In this way, it is guaranteed in any case that the program controlled light effects are adhered to and a small acoustical disturbance may be tolerated if necessary.

When corresponding lighting programs are run under program control, the lighting devices are switched off or on under program control. In this case, the light scenes are predefined in individual lighting steps, which run one after the other under program control. In order to give the user of the lighting control console the opportunity to imperatively preclude an adjustment of the lighting device for individual program steps, the corresponding program steps can be marked in the program sequence in such a manner that the adjustment of the lighting device by moving it using the assigned actuator is precluded in these program steps, irrespective of the result of the comparison of the acoustic parameters that are to be compared with each other.

The invention claimed is:

1. A method for controlling a lighting system using a lighting control console, digital adjusting commands being generated in the lighting control console, said digital adjusting commands being transmitted to a plurality of lighting devices of the lighting system via data links to actuate at least one of the plurality of the lighting devices, and at least one of the plurality of lighting devices being an adjustable lighting device coupled to at least one actuator, the at least one actuator configured to move the at least one adjustable lighting device, and a preprogramed lighting program being carried out in a plurality of consecutive program steps, the preprogrammed lighting program comprising a plurality of acoustic parameters identifying a noise sensitivity for each program step in the plurality of consecutive program steps, the method comprising the following method steps:

a) under control of the preprogrammed lighting program, generating a first digital control switching off the at least one adjustable lighting device such that the at least one adjustable lighting device generates no light;

b) identifying a next program step in the preprogrammed lighting program generating a second digital control switching on the at least one adjustable lighting device at a predefined position;

c) comparing the corresponding acoustic parameters of each of the plurality of program steps occurring after method step a) and before the program step identified in method step b);

d) determining a travel time that is needed to move the at least one adjustable lighting device to the predefined position identified in method step b);

e) driving the actuator, to move the at least one adjustable lighting device to the predefined position identified in method step b) as a function of the result of the comparison of the acoustic parameters or the travel time; and f) generating a second digital adjusting command switching on the at least one adjustable lighting device to generate a light effect in the predefined position identified in method step b).

2. The method according to claim 1, wherein method step e) is carried out during the program step having the acoustic parameter with the lowest noise sensitivity.

3. The method according to claim 1, wherein method step e) is started irrespective of the result of the comparison of the acoustic parameters, at a point of time determined by the travel time.

* * * * *